US006386104B1

(12) United States Patent
Kasai et al.

(10) Patent No.: US 6,386,104 B1
(45) Date of Patent: May 14, 2002

(54) UNDER SHEET FOR LITHOGRAPHIC PRINTING PLATE

(75) Inventors: Seishi Kasai; Eiichi Kato, both of Shizuoka (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 09/709,546

(22) Filed: Nov. 13, 2000

(30) Foreign Application Priority Data

Nov. 12, 1999 (JP) ..... 11-322908

(51) Int. Cl.[7] ..... B41N 6/00

(52) U.S. Cl. ..... 101/375; 101/401.1; 101/401.3; 101/415.1; 101/453

(58) Field of Search ..... 101/217, 375, 101/376, 401.1, 401.3, 413, 415.1, 453, 454, 460, 395

(56) References Cited

U.S. PATENT DOCUMENTS 3,616,178 A * 10/1971 Gurin et al. ..... 101/401.1
3,705,072 A * 12/1972 Rosvold ..... 101/401.1
3,990,897 A * 11/1976 Zuerger et al. ..... 101/401.1
4,367,679 A * 1/1983 Ishii et al. ..... 101/415.1
4,871,631 A * 10/1989 Pieper et al. ..... 101/395
5,410,963 A * 5/1995 Steadman ..... 101/376
5,673,623 A * 10/1997 Schmid ..... 101/415.1
5,775,225 A * 7/1998 Saitou ..... 101/415.1
6,176,182 B1 * 1/2001 Nakayama et al. ..... 101/375

FOREIGN PATENT DOCUMENTS

EP 246012 * 11/1987
EP 1099568 * 5/2001
JP 11-20130 * 1/1999

* cited by examiner

*Primary Examiner*—Stephen R. Funk

(57) ABSTRACT

An under sheet for a lithographic printing plate which has an initial modulus of elasticity of $34\times10^8$ Pa or more, and has concavities and convexities having a central line average roughness (Ra) of less than 2 $\mu$m and Ra/Rz of 0.05 or more on the surface in contact with the back surface of the lithographic printing plate.

3 Claims, No Drawings

UNDER SHEET FOR LITHOGRAPHIC PRINTING PLATE

FIELD OF THE INVENTION

The present invention relates to an under sheet for a lithographic printing plate to prevent the deviation (i.e., the skid) of the position of a lithographic printing plate on the plate cylinder of a printer (i.e., a printing press).

BACKGROUND OF THE INVENTION

Printing is generally performed in a lithographic printer by winding a lithographic printing plate around a plate cylinder to fix the printing plate mechanically.

As the support of a lithographic printing plate, materials such as a metal, a plastic film and a paper have been conventionally used. A lithographic printing plate using materials other than metals as a support is excellent in handling property but is defective in dimensional stability as compared with a lithographic printing plate using a metal as a support.

When a lithographic printing plate having a support at least the back surface of which is a material other than a metal is used in a lithographic printer, the grasp position to the front end of the plate cylinder is liable to be made worse since the support is soft. In such a case the accuracy in the longitudinal position (the accuracy along the circumferential direction of the plate cylinder) becomes worse, and a lithographic printing plate is shifted diagonally and fixed in certain circumstances. Further, there is a problem that a deformation occurs partially due to the friction with a plate cylinder during printing, for instance, and the positional accuracy to the printing paper is deteriorated.

Accordingly, the use of a lithographic printing plate having a support at least whose back surface is a material other than a metal is limited to printing of a small number of papers where no problem arises even if a register accuracy of a printed matter is low, and if such a lithographic printing plate is used in multicolor precise printing or in printing of a large number of papers with a large-sized printer, there are cases where the deviation of colors is caused.

On the other hand, a plate-making method and a printing method by CTP (computer to plate) which have been prevailed in recent years are advantageous in that the dimension of imaging (exposure) and the positional accuracy are excellent and the register in multicolor printing is easy as compared with conventional plate-making and printing methods (exposure process of a printing plate material is performed by contact exposure using a lith film).

However, when a lithographic printing plate having a support comprising a material other than a metal such as a plastic film or paper is used, the advantage of easiness of the register in multicolor printing of CTP cannot be put to practical use due to the above drawback of the printing plate.

Further, it is suggested in recent years to interpose a sheet having an initial modulus of elasticity of $29\times10^8$ Pa (300 kg/mm$^2$) or less between a printing plate and a plate cylinder (as described in JP-A-11-20130 (the term "JP-A" as used herein means an "unexamined published Japanese patent application")). This sheet comprises fine glass beads and the like adhered and fixed so that central line average roughness (Ra) becomes 2 or more.

However, as is described in JP-A-11-20130 that this sheet can be produced by adhering fine glass beads and the like densely and uniformly on the surface of a sheet-like material, a solution having fine particles dispersed therein in high concentration is required to form concavities and convexities on the surface of a sheet.

These kinds of fine particles are generally expensive and a large quantity of fine particles are necessary to adhere them densely and uniformly, which results in the increase of the production cost of a sheet. Moreover, not only it is difficult to disperse fine particles in a solution in high concentration but also dispersion in high concentration is liable to cause the agglomeration of particles in the solution leading to coarse particles, and there arises a problem that the coarse particles deteriorate printing quality.

SUMMARY OF THE INVENTION

An object of the present invention is to provide an under sheet for a lithographic printing plate which can prevent the deviation of the position between the lithographic printing plate and the under sheet before printing and can be produced inexpensively.

The above object of the present invention can be achieved by an under sheet for a lithographic printing plate which has an initial modulus of elasticity of $34\times10^8$ Pa or more, and has concavities and convexities having central line average roughness (Ra) of less than 2 $\mu$m and Ra/Rz of 0.05 or more on the surface in contact with the back surface of the lithographic printing plate.

DETAILED DESCRIPTION OF THE INVENTION

According to the present invention, the skid (i.e., the deviation) of a lithographic printing plate on a plate cylinder caused by the pressure during printing on a lithographic printer can be certainly prevented by an under sheet for a lithographic printing plate which has an initial modulus of elasticity of $34\times10^8$ Pa or more, and has concavities and convexities having central line average (surface) roughness (Ra) of less than 2 $\mu$m and Ra(center line average roughness)/Rz(ten-point mean roughness) of 0. 05 or more on the surface in contact with the back surface of the lithographic printing plate. Ra and Rz can be measured based on JIS B 0601. The term "Initial modulus of elasticity" in the present invention means the modulus of elasticity in the state before the under sheet is used in printing.

An under sheet in the present invention is used by being interposed between a plate cylinder and a lithographic printing plate having a back surface comprising at least a material other than a metal.

The under sheet in the present invention has an initial modulus of elasticity of $34\times10^8$ Pa or more, preferably from $34\times10^8$ to $98\times10^8$ Pa.

As the support for an under sheet, e.g., a metal plate, a resin sheet, and a composite sheet of a metal and a resin are used, preferably a metal sheet such as an aluminum plate, a zinc plate, a titanium plate, and a stainless steel plate, a bimetallic sheet such as a copper-aluminum plate, a copper-stainless steel plate, and a chromium-copper plate, a trimetallic sheet such as a chromium-copper-aluminum plate, a chromium-lead-iron plate, and a chromium-copper-stainless steel plate, a resin sheet such as a PET sheet, a PE sheet, a PP sheet, a polyester sheet, a polyimide sheet, a polyamide sheet, and an acrylate resin sheet, and a metal-resin composite sheet such as an aluminum-PET sheet, an aluminum-PE sheet, an aluminum-polyester sheet, a titanium-PET sheet, and a titanium-PE sheet, and more preferably a metal sheet such as an aluminum plate and a stainless steel plate, a resin sheet such as a PET sheet and a PE sheet, and a metal-resin composite sheet such as an aluminum-PET sheet and an aluminum-polyester sheet can be exemplified.

The thickness of an under sheet is from 50 to 350 μm, preferably from 75 to 300 μm, and more preferably from 100 to 250 μm.

The concavities and convexities are formed on the surface of the under sheet in contact with the back surface for the lithographic printing plate so that the surface of the under sheet has a central line average (surface) roughness (Ra) of less than 2 μm, preferably from 0.5 to 1.95 μm, and more preferably from 1 to 1.95 μm, and Ra/Rz of 0.05 or more, preferably from 0. 05 to 1, and more preferably from 0. 05 to 0.16. The protrusions can be formed by inorganic fine particles, organic fine particles and organic-inorganic composite fine particles.

As the inorganic fine particles, e.g., a metallic powder, a metallic oxide, a metallic nitride, a metallic sulfide, a metallic carbide and composite compounds of these compounds can be exemplified, preferably a metallic oxide and a metallic sulfide, and more preferably a metallic oxide such as glass, $SiO_2$, $TiO_2$, ZnO, $Fe_2O_3$, $ZrO_2$ and $SnO_2$, and a metallic sulfide such as ZnS and Cus can be exemplified.

As the organic fine particles, e.g., synthetic resin particles, natural high molecular weight particles can be exemplified, preferably an acrylate resin, polyethylene, polypropylene, polyethylene oxide, polypropylene oxide, polyethyleneimine, polystyrene, polyurethane, polyurea, polyester, polyamide, polyimide, carboxymethyl cellulose, gelatin, starch, chitin, and chitosan, and more preferably synthetic resin particles such as an acrylate resin, polyethylene, polypropylene, and polystyrene can be exemplified.

Composites comprising these organic and inorganic particles compounded in an arbitrary ratio are used as organic-inorganic composite fine particles.

These particles have an average particle size of from 1 to 100 μm, preferably from 3 to 80 μm, and more preferably from 5 to 50 μm.

In the under sheet for a lithographic printing plate according to the present invention, big protrusions provided on the surface for forming the required concavities and convexities are sufficient at least to prevent the skid of a lithographic printing plate. The big protrusions pressed to the back surface of a lithographic printing plate in the concave state and bite the back surface of a lithographic printing plate. Accordingly, the skid of a lithographic printing plate on a plate cylinder caused by the function of the pressure during printing on a lithographic printer can be certainly inhibited.

In the present invention, concaving of the back surface of a lithographic printing plate may be performed during the process of interposing an under sheet between a plate cylinder and a lithographic printing plate with winding a plate cylinder up with a lithographic printing plate and an under sheet, or the back surface of a lithographic printing plate may not be concaved during the process of interposing an under sheet between a plate cylinder and a lithographic printing plate and may be concaved for the first time when pressure is applied after the process of interposing.

The kind of the lithographic printing plate for use in the present invention is not especially restricted and generally used PS plates, printing plates having a silver diffusible photosensitive layer, and electrophotographic printing plates may be used.

As the method of forming concavities and convexities on the surface of the support for an under sheet, a method of fixing the fine particles of glass and the like, which is harder than the material of the back surface of the support of a lithographic printing plate, on the surface of an under sheet having an initial modulus of elasticity of $34\times10^8$ Pa or more to form concavities and convexities can be exemplified.

As the specific examples of fixing fine particles on the surface of an under sheet to form concavities and convexities, a method of dispersing a coating solution comprising a binder having dispersed therein fine particles and coating the solution and drying, a method of preparing a binder film and then pushing fine particles into the binder film by mechanical pressure, and a method of preparing a binder film and electro-depositing fine particles can be exemplified.

A resin emulsion, a resin soluble in a solvent, an inorganic sol-gel and a resin-inorganic sol-gel composite are used as a binder, preferably a resin emulsion such as an acryl emulsion, a urethane emulsion, a polyethylene emulsion, a vinyl acetate emulsion, and a polyester emulsion; a resin soluble in a solvent such as an acrylate resin, polyethylene, vinyl acetate, polyurethane, polyester, and polyvinyl chloride; an inorganic sol-gel such as a silica sol-gel, a titanium sol-gel, and an aluminum sol-gel; a resin-inorganic sol-gel composite such as a polyvinyl pyrrolidone-silica composite sol-gel, a PVA-silica composite sol-gel, and a carboxymethyl cellulose-silica composite sol-gel; and more preferably a resin emulsion such as an acryl emulsion and a urethane emulsion; a resin soluble in a solvent such as an acrylate resin and polyethylene; an inorganic sol-gel such as silica sol-gel; and a resin-inorganic sol-gel composite such as a polyvinyl pyrrolidone-silica composite sol-gel and a PVA-silica composite sol-gel can be exemplified. These binders may be hardened by a self-crosslinking reaction and/or the introduction of crosslinking structure by using a crosslinking agent during film formation by drying.

As the method of fixing an under sheet on a plate cylinder, a method of providing an adhesive layer on the back surface of the support for an under sheet and using an adhesive or a pressure-sensitive adhesive such as a spray adhesive or a double-faced adhesive tape on the adhesive layer, a method of fixing the front end and the rear end of an under sheet by the clips provided on a plate cylinder and not providing an adhesive layer on an under sheet, or a method of combining these methods can be used.

The embodiment of the present invention will be described below.

When printing is performed with a lithographic printer, each lithographic printing plate is mounted on the plate cylinder of each printing unit via an under sheet. At this time, each under sheet is pressed to the back surface of the lithographic printing plate, thereby the protrusions on the surface of the under sheet concave the back surface of the lithographic printing plate to form concavities.

Thus, each under sheet adjusts the pressure by a rubber cylinder and an impression cylinder and at the same time prevents the positional deviation (i.e., positional skid) of the lithographic printing plate on the plate cylinder due to pressure.

In the next place, a method of preventing the positional deviation of a lithographic printing plate is described.

An under sheet having concavities and convexities of required contours on the surface thereof is interposed between a lithographic printing plate and a plate cylinder of each printing unit. At this time, the concavities and convexities on the surface of the under sheet are pressed to the back surface of each lithographic printing plate and the protrusions on the surface of each under sheet bite the back surface of each lithographic printing plate, thus the back surface of the lithographic printing plate is concaved concurrently with the concavities and convexities of the under sheet.

Example

In the next place, printing was performed using a lithographic printer, an under sheet according to the embodiment of the present invention and an under sheet in which the concavities and convexities are provided on the surface of the under sheet out of the scope of the present invention as a comparative example, and then the positional deviation (i.e., the positional skid) of the lithographic printing plate on the plate cylinder was measured. The specific conditions and the results are shown below.

Example 1

Various kinds of resin sheets each having the initial modulus of elasticity shown in Table 1 were used as the under sheets. Glass fine particles (GB731, manufactured by Toshiba Glass Co., Ltd.) were classified into sizes of from 1 to 100 μm by means of a centrifugal separator for powder and glass particles having different sizes were obtained. These particles were coated on the under sheet by electrostatic coating in the central line average (surface) roughness (Ra) of the under sheet of less than 2 μm and Ra/Rz of 0.05 or more. Subsequently, this under sheet was superposed on a chromium-plated metal plate with the coated side of the under sheet up and they were put in an oven at 120° C. for 1 minute to adhere and fix the particles on the under sheet.

TABLE 1

| Material of Sheet | Initial Modulus of Elasticity ($\times 10^8$ Pa) |
|---|---|
| High density polyethylene | 29 |
| Acrylate resin | 34 |
| PET | 44 |
| Aluminum | 98 or more |

As the lithographic printing plate, that which was prepared by plate-making a silver diffusible photosensitive material ("Super Master Plus" manufactured by Agfa Gevaert Co.) on a polyethylene terephthalate (PET) support having a thickness of 100 μm (the total thickness: 130 μm) by a special purpose plate maker SPM415 was used. Further, a lithographic printing plate can be prepared by a direct-drawing printing plate comprising a support other than a metal having provided thereon an image-receiving layer or electrophotographic plate-making using an electrophotographic system.

Then, the obtained under sheet and lithographic printing plate were cut each in a width of 560 mm and a length of 400 mm, and the lithographic printing plate was laid on the top of the under sheet so that the back surface of the lithographic printing plate was contact with the surface of the under sheet on which concavities and convexities were provided. The lithographic printing plate and the under sheet laid to overlap each other were mounted on the plate cylinder of a single-sided printer ("Oliver 52" manufactured by Sakurai Co., Ltd.), and 200 sheets of paper were printed.

Before printing, the surface of the lithographic printing plate was squeegeed with a sponge impregnated with processing solution G671c. As the fountain solution on the printer, processing solution G671c diluted with water in a ratio of 1/1 was used and New Champion F Gloss 85 (manufactured by Dainippon Ink & Chemicals Inc.) was used as the ink.

The position of the ruled line printed on the printed paper just after starting printing and that on the printed paper after printing 2,000 sheets of paper were compared and the positional deviation of the lithographic printing plate on the plate cylinder after printing 2,000 sheets of paper from that just after starting printing was measured. The evaluation was performed by visually judging the degree of peeling-off of particles of a certain area of the surface of the lithographic printing plate after printing with an optical microscope.

Comparative Example 1

As the under sheets, an under sheet comprising the same polyethylene terephthalate (PET) support having a thickness of 100 μm as used in Example 1 but not having provided concavities and convexities on the surface, that having provided concavities and convexities having central line average (surface) roughness (Ra) out of the scope of the present invention, and that having an initial modulus of elasticity out of the scope of the present invention were used, and 2,000 sheets of paper were printed in the same manner as in Example 1 using the same lithographic printing plate and the same printer.

The results obtained in Example 1 and Comparative Example 1 are shown below in Tables 2 to 5. The symbols in each column are deviation of a printing plate, printing unevenness, and peeling-off of particles from the left to the right respectively. The inside of the enclosure of thick lines is the present invention.

TABLE 2

Initial Modulus of Elasticity: $29 \times 10^8$ Pa

| Surface Roughness Ra (μm) | Ra/Rz: Less than 0.05 | 0.05 | 0.1 | 0.2 | 0.5 or more |
|---|---|---|---|---|---|
| 0.2 | x ○ ○ | x ○ ○ | x ○ ○ | x ○ ○ | x ○ ○ |
| 0.5 | x ○ ○ | x ○ ○ | x ○ ○ | x ○ ○ | x ○ ○ |
| 1.0 | x ○ ○ | x ○ ○ | x ○ ○ | x ○ ○ | x ○ ○ |
| 1.5 | x ○ ○ | x ○ ○ | x ○ ○ | x ○ ○ | x ○ ○ |
| 1.9 | x ○ ○ | x ○ ○ | x ○ ○ | x ○ ○ | x ○ ○ |
| 2.0 | ○ ○ x | x ○ ○ | ○ ○ x | ○ ○ x | ○ ○ x |
| 5.0 | ○ x x | ○ ○ x | ○ ○ x | ○ ○ x | ○ ○ x |

TABLE 3

Initial Modulus of Elasticity: $34 \times 10^8$ Pa

| Surface Roughness Ra (μm) | Ra/Rz: Less than 0.05 | 0.05 | 0.1 | 0.2 | 0.5 or more |
|---|---|---|---|---|---|
| 0.2 | x ○ ○ | ○ ○ ○ | ○ ○ ○ | ○ ○ ○ | ○ ○ ○ |
| 0.5 | x ○ ○ | ○ ○ ○ | ○ ○ ○ | ○ ○ ○ | ○ ○ ○ |
| 1.0 | ○ x x | ○ ○ ○ | ○ ○ ○ | ○ ○ ○ | ○ ○ ○ |
| 1.5 | ○ x x | ○ ○ ○ | ○ ○ ○ | ○ ○ ○ | ○ ○ ○ |
| 1.9 | ○ x x | ○ ○ ○ | ○ ○ ○ | ○ ○ ○ | ○ ○ ○ |
| 2.0 | ○ x x | ○ ○ x | ○ ○ x | ○ ○ x | ○ ○ x |
| 5.0 | ○ x x | ○ ○ x | ○ ○ x | ○ ○ x | ○ ○ x |

TABLE 4

Initial Modulus of Elasticity: 44 × $10^6$ Pa

| Surface Roughness Ra (μm) | Ra/Rz Less than 0.05 | 0.05 | 0.1 | 0.2 | 0.5 or more |
|---|---|---|---|---|---|
| 0.2 | x ○ ○ | ○ ○ ○ | ○ ○ ○ | ○ ○ ○ | ○ ○ ○ |
| 0.5 | x ○ ○ | ○ ○ ○ | ○ ○ ○ | ○ ○ ○ | ○ ○ ○ |
| 1.0 | ○ x x | ○ ○ ○ | ○ ○ ○ | ○ ○ ○ | ○ ○ ○ |
| 1.5 | ○ x x | ○ ○ ○ | ○ ○ ○ | ○ ○ ○ | ○ ○ ○ |
| 1.9 | ○ x x | ○ ○ ○ | ○ ○ ○ | ○ ○ ○ | ○ ○ ○ |
| 2.0 | ○ x x | ○ ○ x | ○ ○ x | ○ ○ x | ○ ○ x |
| 5.0 | ○ x x | ○ ○ x | ○ ○ x | ○ ○ x | ○ ○ x |

TABLE 5

Initial Modulus of Elasticity: 98 × $10^8$ Pa

| Surface Roughness Ra (μm) | Ra/Rz Less than 0.05 | 0.05 | 0.1 | 0.2 | 0.5 or more |
|---|---|---|---|---|---|
| 0.2 | x ○ ○ | ○ ○ ○ | ○ ○ ○ | ○ ○ ○ | ○ ○ ○ |
| 0.5 | x ○ ○ | ○ ○ ○ | ○ ○ ○ | ○ ○ ○ | ○ ○ ○ |
| 1.0 | ○ x x | ○ ○ ○ | ○ ○ ○ | ○ ○ ○ | ○ ○ ○ |
| 1.5 | ○ x x | ○ ○ ○ | ○ ○ ○ | ○ ○ ○ | ○ ○ ○ |
| 1.9 | ○ x x | ○ ○ ○ | ○ ○ ○ | ○ ○ ○ | ○ ○ ○ |
| 2.0 | ○ x x | ○ ○ x | ○ ○ x | ○ ○ x | ○ ○ x |
| 5.0 | ○ x x | ○ ○ x | ○ ○ x | ○ ○ x | ○ ○ x |

The criteria of evaluation in each table are as follows.

Criteria of Evaluation

Deviation of Printing Plate

○: Less than 50 μm

Δ: 50 μm or more and less than 100 μm

×: 100 μm or more

Printing Unevenness

○: Nothing

×: Extremely observed

Peeling-off of Particles

○: Nothing

×: Extremely observed

In addition to the deviation of the printing plate, printing unevenness of the printed matters was observed. Printing unevenness is construed as that if there are coarse particles (i.e., coarse roughnesses) on the surface of an under sheet, the coarse particles deform the soft support, e.g., PET, of a printing plate and protrude that part of the surface of the printing plate, as a result, spotted printing stains are generated, which are confirmed as printing unevenness on printed matters.

Further, when there are coarse particles on the surface of an under sheet or when the surface is coarse, the elongation of a printing plate is inhibited but printing unevenness is liable to occur as described above and, moreover, peeling-off of particles occurs, as a result, the performance of the printing plate is deteriorated by repeated use.

As is apparent from the results shown in Tables 2 to 5, when the initial modulus of elasticity of an under sheet is 29×$10^8$ Pa or less, which is out of the scope of the present invention, all the performances become unsatisfactory due to the deviation of the printing plate and the generation of peeling-off of particles resulting from the dents of the under sheet, regardless of central line average roughness Ra and Ra/Rz.

On the other hand, all the performances are satisfied when the initial modulus of elasticity of an under sheet is 34×$10^8$ Pa or more, the central line average (surface) roughness (Ra) is less than 2 μm and Ra/Rz is 0.05 or more, which are within the scope of the present invention.

However, even if the initial modulus of elasticity of an under sheet is 34×$10^8$ Pa or more, when central line average roughness (Ra) exceeds 2 μm, printing unevenness and peeling-off of particles become conspicuous and when Ra/Rz is less than 0.05, the elongation of a printing plate, printing unevenness and peeling-off of particles occur.

That is, the deviation of a printing plate, printing unevenness and peeling-off of particles can be effectively prevented when the initial modulus of elasticity of an under sheet is 34×$10^8$ Pa or more, central line average roughness (Ra) is less than 2 μm and Ra/Rz is 0.05 or more.

Therefore, it is thought that extraordinary big protrusions occur when central line average roughness (Ra) becomes large and the parameter of the uniformity of concavity/convexity (Ra/Rz) becomes small, as a result, printing unevenness and peeling-off of particles are liable to occur.

Further, it is thought that when the initial modulus of elasticity of the support for an under sheet is small, dents occur in protrusions during printing and the protrusions are liable to lose effective grasp.

EFFECT OF THE INVENTION

According to the present invention, when the central line average (surface) roughness (Ra) of an under sheet provided on the surface in contact with the back surface of the lithographic printing plate is less than 2 μm and Ra/Rz is 0.05 or more, the deviation of a printing plate can be prevented and an under sheet having excellent productivity can be manufactured inexpensively. Furthermore, when the initial modulus of elasticity of an under sheet is 34×$10^8$ Pa or more, the concavities and convexities on the surface effectively concave the back surface of a lithographic printing plate, thus hard particles such as glass can be effectively used without being destroyed.

While the invention has been described in detail and with reference to specific examples thereof, it will be apparent to one skilled in the art that various changes and modifications can be made therein without departing from the spirit and scope thereof.

What is claimed is:

1. An under sheet for a lithographic printing plate which has initial elasticity of 34×$10^8$ Pa or more, and has concavities and convxities having a central line average roughness (Ra) of less than 2 μm and Ra/Rz of 0.05 or more on the surface in contact with the back surface of the lithographic printing plate.

2. The under sheet for a lithographic printing plate as in claim 1, wherein said under sheet has an initial modulus of elasticity of 34×$10^8$ Pa to 98×$10^8$ Pa.

3. The under sheet for a lithographic printing plate as in claim 1, wherein said under sheet has a thickness of 50 to 350 μm.

* * * * *